United States Patent [19]

Beaudette

[11] 4,373,463

[45] Feb. 15, 1983

[54] CLEAT DEVICE

[76] Inventor: Jerald G. Beaudette, 5042 Bryant Ave., South, Minneapolis, Minn. 55419

[21] Appl. No.: 175,484

[22] Filed: Aug. 5, 1980

[51] Int. Cl.[3] ..... B63B 21/04

[52] U.S. Cl. ..... 114/218; 24/129 R

[58] Field of Search ..... 114/210, 218, 199; 24/115 H, 117, 129 R, 129 W, 137 R, 201 HH, 230.5 R, 230.5 W, 230.5 AD, 265 H, 130; D8/382, 356

[56] References Cited

U.S. PATENT DOCUMENTS

| | | | |
|---|---|---|---|
| D. 209,330 | 11/1967 | Coderre | D8/382 |
| 556,485 | 3/1896 | Wilson | 24/129 R |
| 942,009 | 11/1909 | Mueller | 24/129 R |
| 966,297 | 8/1910 | Bart . | |
| 986,014 | 3/1911 | Krenzke . | |
| 1,251,778 | 1/1918 | Humble . | |
| 1,531,746 | 3/1925 | Fort | 24/129 R |
| 2,430,980 | 11/1947 | Goodwin | 24/129 R |
| 3,125,978 | 3/1964 | Faul | 114/218 |
| 3,233,934 | 2/1966 | Osborn et al. | 114/218 |
| 3,988,810 | 11/1976 | Emery . | |

FOREIGN PATENT DOCUMENTS

| | | | |
|---|---|---|---|
| 1568849 | 1/1968 | France | 114/218 |

*Primary Examiner*—Trygve M. Blix
*Assistant Examiner*—Stephen P. Avila
*Attorney, Agent, or Firm*—Kinney, Lange, Braddock, Westman & Fairbairn

[57] ABSTRACT

For rapidly restraining and releasing a flexible line, a cleat device including a base; a plurality of at least three jam cleats mounted on said base in juxtaposition with adjacent open ends facing in opposite directions; and at least one pair of hooks, one each on the base adjacent and outside the first and last jam cleats. The jam cleats each include an upper face and a lower face converging to form a first acute angle. In a preferred embodiment, at least one face of each jam cleat includes a longitudinally extending ridge thereon.

2 Claims, 6 Drawing Figures

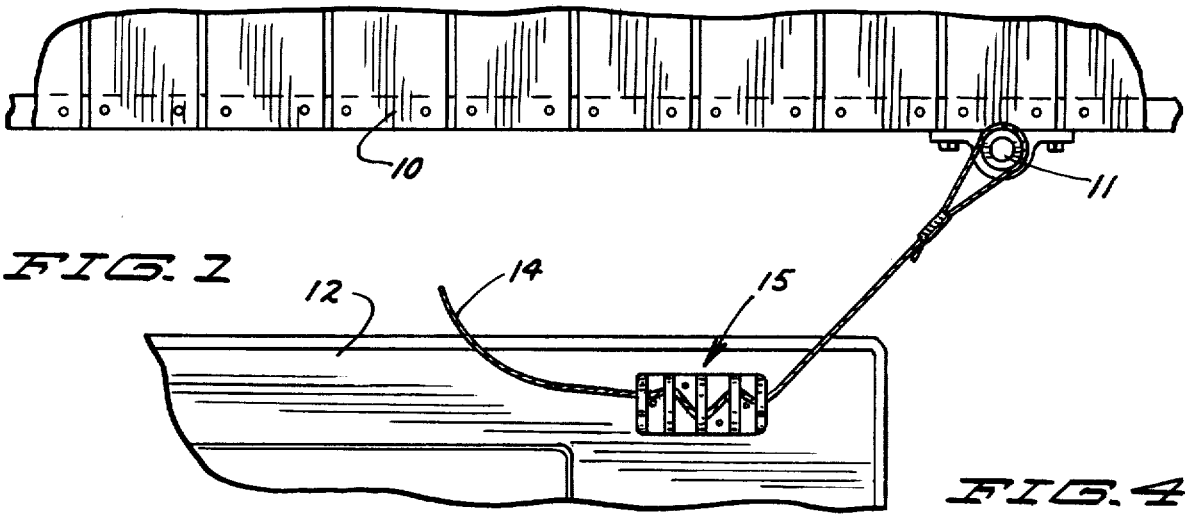
FIG. 1
FIG. 4
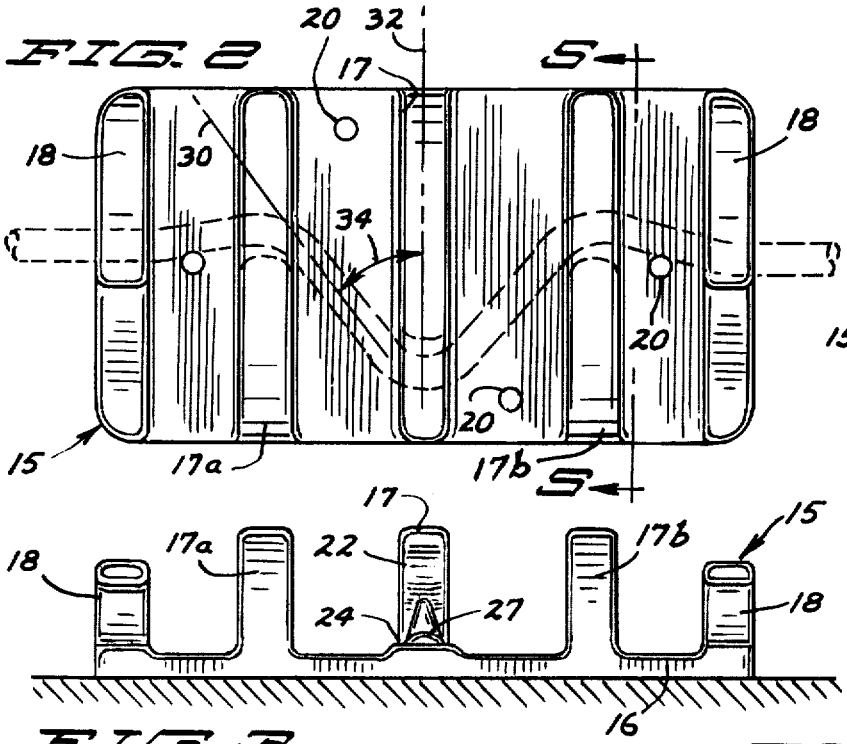
FIG. 2
FIG. 3
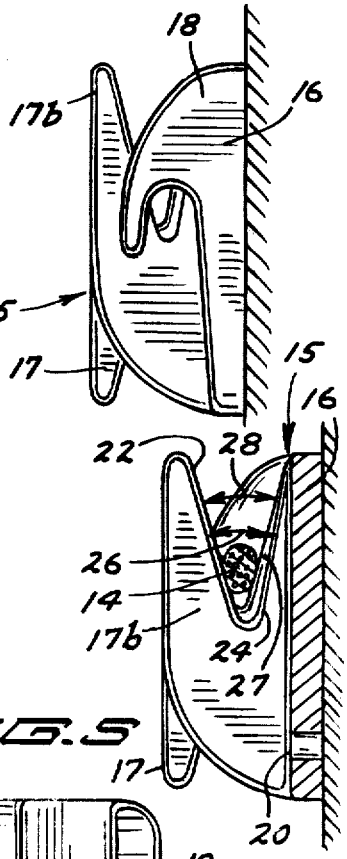
FIG. 5
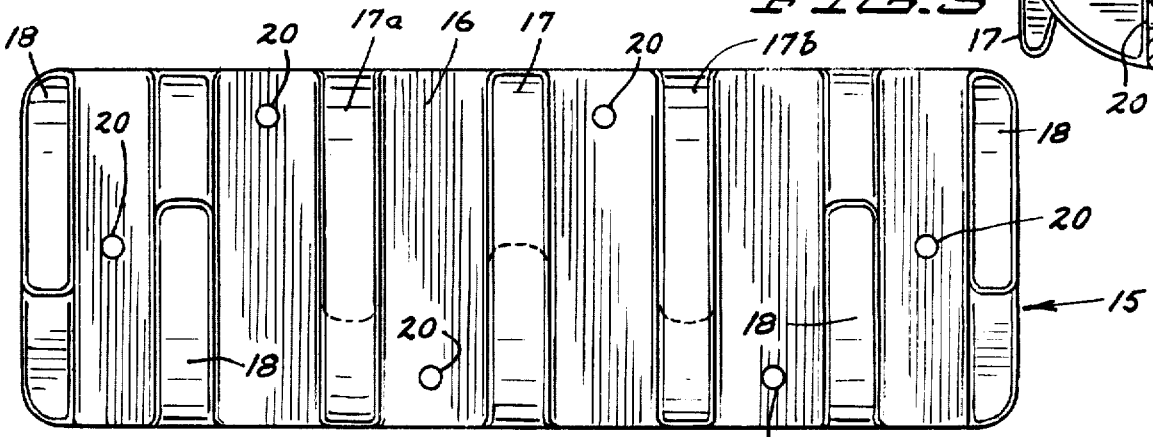
FIG. 6

CLEAT DEVICE

BACKGROUND OF THE INVENTION

Man has spent much of recorded history devising new methods of fastening objects to one another. Devices ranging from simple ropes to elaborate and complicated fasteners have been developed to meet the joint goals of absolute security when fastened with utmost ease in fastening and unfastening.

When rope has been employed as a fastening agent, inventive efforts have been expended in devising knots for tying the rope and also in devising fasteners or cleats to which the rope may be attached. Various fasteners of many types may be found in the following:

- U.S. Pat. No. 85,612 granted to Phillips et al in January of 1869;
- U.S. Pat. No. 962,675 granted to Sims in June of 1910;
- U.S. Pat. No. 1,968,935 granted to Fisher in August of 1934;
- U.S. Pat. No. 2,166,847 granted to Miller et al in July of 1939;
- U.S. Pat. No. 2,450,815 granted to Schultz in October of 1948;
- U.S. Pat. No. 2,510,862 granted to Buehl in June of 1950;
- U.S. Pat. No. 3,090,343 granted to Ronsheim in May of 1963;
- U.S. Pat. No. b 3,473,505 granted to Brown in October of 1969;
- U.S. Pat. No. 3,645,032 granted to Gilliam in February of 1972;
- U.S. Pat. No. 3,948,203 granted to Matthews in April of 1976;
- U.S. Pat. No. 4,084,532 granted to Feder in April of 1978; and
- U.S. Pat. No. 4,173,194 granted to McLaughlin in November of 1979.

While all of these patents disclose various cleats which are useful for interacting with ropes, none of them have the security, speed and simplicity that would be most desirable in a fastener for use in combination with a rope.

U.S. Pat. No. 966,297 granted to Bart in August of 1910 discloses a three lug line holder which can be adjusted to accommodate various thicknesses of ropes by use of inserts to vary the distance that the plate is separated from the deck or whatever the device is attached to. Each of the lugs abuts against the base of the device to form a right angle.

In a more ornate version, U.S. Pat. No. 986,014 granted to Krenzke in March of 1911 discloses a rope hitch which uses a flat plate and a tongue has a tapered or jam type cleat. The device includes two ears on the side of the cleat so that tension on the rope forces the rope into the tapered or jam cleat.

Similarly, U.S. Pat. No. 1,251,778 granted to Humble in January of 1918 discloses a transverse V-shaped slot, like a tapered cleat, at right angles from the frame. The outer hooks are designed to alter the path of the rope so that it deviates from a straight line. Similarly, the transverse V-shaped slot is canted at an angle from the line of straight rope travel.

U.S. Pat. No. 3,988,810 granted to Emery in November of 1976 discloses a jamming cleat where the cord is held between a V-shaped groove such that the walls are formed with a ridge sloped in such a way that the greater the load on the cord, the more securely the cord is held in the groove. On each wall of the V-shaped cleat, at least one ridge is formed which extends from the trough of the groove toward the head at an angle of between 20° and 50° with respect to the trough. The theory behind this ridge is that it assists in forcing the cord further into the groove when tension is placed on the cord.

The foregoing patents were located in a preliminary seach. Applicant and those in privity with him know of no closer prior art than that set out above; and they know of no prior art which anticipates the claim made in this application.

SUMMARY OF THE INVENTION

It has now been discovered that a simple and effective cleat for fastening ropes can be provided in the following manner. The cleat device of the present invention is absolutely secure in restraining movement of a rope, cord or other line employed therewith, yet it is simple and effortless in its use.

Specifically, the present invention comprises a device for easily restraining and releasing a flexible line. Ropes, lines and cords are made from an almost unlimited variety of materials, such as hemp, sisal, cotton, nylon, various synthetics, and the like. Also, many ropes or cables are made from multiple components, such as plastic coated wire, and the like. Elastic lines will also work well. It is preferred that the line or rope employed in combination with the present invention be constructed so as to avoid metal on metal contact. However, if it is recognized that metal can damage metal, a metallic cable could be employed with the present invention if necessary.

The cleat device itself comprises a base; a plurality of at least three jam cleats mounted on the base in juxtaposition, with adjacent open ends facing in opposite directions; and at least one pair of hooks, one each on the base adjacent and outside the first and last jam cleat. The jam cleats each include an upper face and a lower face which converge to form an acute angle. Preferably, this acute angle ranges from 10° to 50°, with a preferred range being from 15° to 30°. At least one of the faces of each of the jam cleats includes at least one ridge which, by its presence, may form a larger or smaller acute angle with the other face than does the ridged face itself; or may be parallel with the ridged face to form the same angle. In the preferred embodiment, one ridge is shown on one face. Preferably, this angle will range from 15° to 60° and preferably from 20° to 40°. The base, normally, will include means for mounting the cleat device to a larger object such as a boat, a dock, or a truck, or the like.

When a line is cleated by the device of this invention, it passes between successive jam cleats. In so doing, the line forms an angle with respect to the longitudinal axis of each of the jam cleats. Preferably, this angle is an acute angle and may range from 10° to 80°. The line is maintained in operative, jammed relation with respect to the outer jam cleats by being positioned within the hooks. The bend in the line where it passes through successive jam cleats is known as a "bight". See Webster's New International Dictionary, Second Edition, Unabridged, published by G. & C. Merriam Company of Springfield, Mass. in 1967.

IN THE DRAWINGS

FIG. 1 is a fragmentary view of a portion of a boat dock and of a boat, showing their relationship to a mooring line and a first form of cleat device of the present invention;

FIG. 2 is an enlarged top plan view of the cleat device shown in FIG. 1;

FIG. 3 is a side view of the device shown in FIGS. 1 and 2;

FIG. 4 is an end view of the device shown in FIGS. 1, 2 and 3;

FIG. 5 is a vertical sectional view taken on line 5—5 in FIG. 2; and

FIG. 6 is a top plan view of a second form of the present invention.

DESCRIPTION OF PREFERRED EMBODIMENTS

As shown in FIG. 1, a dock 10 has a support 11 for mooring a boat 12 thereto. A mooring line 14 is attached at one end to support 11 and at the other end to a cleat device 15 of the present invention. The mooring line between the support 11 and the cleat device 15 is known as the "standing part" of the line 14. See Webster's New International Dictionary, supra.

The cleat device 15 of the first form of the invention, as seen in FIGS. 1 through 5, includes a base 16 on which are cast three jam cleats 17, 17*a* and 17*b* in juxtaposition, with the adjacent open ends facing in opposite directions. A pair of hooks 18,18 are mounted on the base 16 and are outside the first and last cleat means 17*a* and 17*b*. Holes 20 are provided in base 16 for mounting the cleat device to a larger structure, such as a boat, truck or other fixture.

Each jam cleat 17 includes a plane upper working face 22 and a plane lower working face 24, the two of which converge into a groove to form an acute angle 26. This angle preferably will range from about 10° to about 50°, with the most preferred angle 26 being from about 15° to about 30°.

In the forms of the invention as shown, included on the cleat face 24 is a ridge 27 which forms a larger acute angle 28 with the other face 22. As shown, the ridge does not extend to the outer, parallel edges of the cleat face 24. Angle 28 preferably ranges from about 15° to about 60°, and most preferably from about 20° to about 40°. Typically, as can be seen in FIG. 3, the ridge 27 of cleat 17 does not extend completely across the width of bottom face 24. In this manner, the ridge 27 and the outer edges of the working face 24 all impinge on the line 14 to insure a secure cleating action.

In other forms of the invention, without departing from the spirit of this disclosure and the scope of the claims which follow, ridge means such as ridge 27 on face 24 can form a smaller acute angle with the other face 22, or can be parallel with the angle of the face 24 thus forming the same angle as face 24 forms with the other face 22. In some forms of the invention, each of the faces such as 22 and 24 can include a ridge such as the ridge 27, or one or both of these faces can include a twin ridge having two peaks. These ridges insure that not only the outer edges of the working faces 22 and 24 impinge on the line 14 but also that the peaks of the ridges impinge on the line 14 thus to insure a secure cleating action.

As shown in FIG. 1, line 14 passes through the cleat device 15 in such a manner that it deviates from a straight line. The tighter the line is pulled, the more tightly the individual jam cleats restrict the movement of the line. As the line 14 passes between successive cleats, such as 17 and 17*a*, the axis 30 of the line between those cleats forms an angle 34 with the longitudinal axis 32 of cleat 17. Angle 34 is an acute angle ranging from about 10° to about 80°. This angle 34 insures that stress on the line 14 will cause the line to further compact both into cleat 17*a* and into cleat 17. The line 14 jams into cleats 17 and 17*b* due to the angle of the axis of the line between those cleats in a similar manner. The ends of the line are held in proper alignment outside cleats 17*a* and 17*b* by hooks 18,18. As long as this is so, no amount of steady or intermittent pulling on the loaded part of the line will dislodge the line from any of the three jam cleats and there will be no appreciable longitudinal movement of the line.

In order to release line 14 from cleat device 15, it is necessary only to lift a flat end of the line 14 adjacent one of the hooks 18, move the end of the line toward the jam cleats and past the end of the hook, then pull the line out of the next adjacent jam cleat, lift it over that cleat, pull it out of the center cleat 17, lift it over the cleat 17 and pull it out of the farthest cleat and the remaining hook 18. Due to the presence of ridge 27 in each of the jam cleats, the area of the line 14 which is actually compressed and held between that ridge and the outer edges of lower working face 24 on the one hand and the upper working face 22 on the other is small and the effort needed to bring the line 14 out of any particular jam cleat is negligible. Thus with one hand and with little or no effort, the smallest person can very rapidly release line 14 from the cleat device 15.

Similarly, when it is desired to cleat the line 14 to the cleat device, it is necessary only to lay the line first under one of the hooks 18, then into the first adjacent jam cleat, the center jam cleat 17, the next adjacent jam cleat and under the other hook 18. The line can be pulled taut after it first gets under the jam cleat 17, but it need not be. It has been found that if the line is simply set loosely in the cleat device 15 in the manner set out above, as soon as a strain is applied to either free end of the line 14, the line will creep very slightly through the first adjacent jam cleat and sets firmly in the center jam cleat 17 with the restraining action of the farthest jam cleat. Because of the angle between the farthest hook 18 and the farthest jam cleat, this setting up is automatic. Once the line is set up, all creeping ceases, and the line will be permanently and securely moored to the cleat device 15 until such time as it is released in the manner described above.

Various sizes of ropes can be employed in a single device. For example, one device used for mooring a boat to a dock can accommodate cords ranging from ¼" diameter to ⅝" diameter with great facility.

In a second form of the invention as seen in FIG. 6, a second form of cleat device includes the three jam cleats 17, 17*a* and 17*b* of the device of the first form of the invention and also hooks 18,18, immediately adjacent to the jam cleats 17*a* and 17*b*. However, the base 16 has been elongated to accommodate two more hooks 18,18, each spaced from the center hooks and each opening in a direction opposite to that of the center hooks. In situations such as that illustrated in FIG. 1, the device of FIGS. 1 through 5 will be entirely satisfactory. However, should the cleat device of the invention be mounted on a longitudinal vertical axis against the sides of a truck so that a tarpaulin over the top of the truck can be tied down using lines hanging vertically from the tarpaulin and passing through a plurality of such cleats, for example, the wind whipping the ends of the line hanging vertically below the cleat of the first form of the invention could, conceivably, lift the line out from under the lowest hook 18. Further whipping of the line might possibly allow the approach angle of the line 14 to the adjacent jam cleat to be changed such that the rope would begin to creep through the jam cleat, thus releasing or partially releasing the load.

To take care of this eventuality, the cleat device of the second form of the invention was developed. It is to be noted that the upper arms of the hooks 18,18 extend farther toward the opposite side of the base 16, making it virtually impossible or at least highly unlikely that a rope hanging vertically from the cleat 17*a* (to the left as seen in FIG. 6) could accidentally get out from under either of the adjacent hooks 18,18.

Evidently, retaining and releasing the line 14 would be virtually as easy with this form of the invention as with the first form of the invention.

As can be seen, the devices of the present invention can be mounted in any convenient position to secure a boat or a truck tarpaulin or something else which is subjected to movement or vibration. The minimum of three jam cleats with the centering hooks on the outside of these cleats provide the secure grip on the line which does not loosen when tension on the line is increased and decreased. The device is relatively compact in size, and has a low profile and can be mounted on a wide variety of different surfaces.

The embodiments of the invention in which an exclusive property or privilege is claimed are defined as follows:

1. A cleat device on a larger structure for restraining a flexible line including:

A. a base fixedly mounted to said larger structure;

B. a plurality of at least three parallel, spaced-apart, jam cleats mounted on said base in juxtaposition, with adjacent open ends facing in opposition directions, said jam cleats each including a planar upper face and a planar lower face converging to form a first acute angle;

C. at least one of said faces of each of said jam cleats including a longitudinally extending ridge thereon forming a second acute angle with the other face, said rib being centrally aligned with its working face and said rib not extending entirely across the width of the face and said first angle ranges from 10° to 50° and said second angle ranges from 15° to 60°; and D. means to maintain a line cleated in said jam cleats so that its axis is in direction to maintain said line in jammed relationship with respect to the outermost jam cleats.

2. The cleat device of claim 1 wherein said second angle ranges from 20° to 40°.

* * * * *